United States Patent [19]

Lambeck

[11] 4,449,898

[45] May 22, 1984

[54] POWER TRANSMISSION

[75] Inventor: Raymond P. Lambeck, Bloomfield Hills, Mich.

[73] Assignee: Vickers, Incorporated, Troy, Mich.

[21] Appl. No.: 385,462

[22] Filed: Jun. 7, 1982

[51] Int. Cl.[3] ..... F04C 2/10; F03C 2/00

[52] U.S. Cl. ..... 418/61 B; 137/625.2

[58] Field of Search ..... 418/61 B; 137/625.46, 137/625.2; 251/174, 192; 91/467, 470

[56] References Cited

U.S. PATENT DOCUMENTS

| | | | |
|---|---|---|---|
| 1,742,828 | 1/1930 | Schmalz | 251/192 |
| 3,748,063 | 7/1973 | Putnam | 418/135 |
| 4,298,318 | 11/1981 | Tsuchiya et al. | 418/61 B |

*Primary Examiner*—John J. Vrablik
*Assistant Examiner*—John J. McGlew, Jr.
*Attorney, Agent, or Firm*—Barnes, Kisselle, Raisch, Choate, Whittemore & Hulbert

[57] ABSTRACT

A rotary valve for changing the connections of the fluid inlet passages and the fluid outlet passages of a Gerotor type fluid rotary machine in which the fluid is contracted and expanded by a plurality of cavities defined by the teeth formed on a stator and a rotor in response to the orbital rotation of the rotor formed with one less external tooth than the number of the internal teeth on the stator. The rotary valve selectively communicates the fluid passages with the Gerotor cavities by means of its rotary commutator which orbits with a phase difference of 90° with respect to the Gerotor rotor, and the commutator is rotatably accommodated in a spacer disposed between an end cover and a port member having a plurality of fluid passages. The clearance at each side of the commutator is permanently determined by means of the width of the spacer.The commutator comprises spaced members that move in unison with a sealing ring interposed between the two members.

5 Claims, 9 Drawing Figures

POWER TRANSMISSION

BACKGROUND AND SUMMARY OF THE INVENTION

The present invention relates to rotary valves designed for use with Gerotor rotary machines which are used as fluid pumps or motors in which the fluid introduced is contracted and expanded by a meshing gear system generally known as a Gerotor, and more particularly the invention relates to a rotary valve including sealing means designed to prevent leakage of fluid between the high pressure side and the low pressure side of the commutator.

With a fluid motor or pump of the Gerotor type in which a rotor formed with one less external tooth than the number of internal teeth of a stator, is rotated in eccentric mesh with the stator and a plurality of expanding and contracting cavities are defined by the teeth of the stator and the rotor in response to the eccentric rotation of the rotor, it has been the practice to use a rotary valve so as to selectively communicate the fluid passages with the Gerotor cavities so that a hydraulic oil is supplied to impart a turning force to the rotor in the case of a fluid motor, while a hydraulic oil is discharged from the contracting Gerotor cavities in the case of a fluid pump.

With a known rotary valve of this type, due to the fact that the commutator is rotated within the valve chamber, a clearance which is as small as to not impede the rotation of the commutator is provided at each side of the commutator, and consequently there is a disadvantage that the oil tends to leak from the high pressure side to the low pressure side within the valve chamber, thus deteriorating the volumetric efficiency of a motor or pump. As a result, the width of the clearance on each side of the commutator has been made very small so far as the rotation of the commutator is not impeded, thus requiring a high degree of finishing accuracy for the component parts of the rotary valve. However, there is a disadvantage that even if the component parts with a high degree of finishing accuracy are used, the clamping force of bolts or the like used in assembling the valve tends to distort the component parts of the valve chamber and moreover the existence of the high oil pressure portion and the low oil pressure portion within the valve chamber tends to similarly distort the component parts of the valve chamber by the pressure difference between the two portions, thus increasing the width of the clearance at each side of the commutator. This condition may be aggravated when thermal expansion occurs in use causing mechanical seizure of the parts.

It has been further found that upon continued operation of the Gerotor unit, and resultant thermal expansion, there is tendency for the commutator to expand and through mechanical seizure be prevented from rotation.

In U.S. Pat. No. 3,452,680, it has been proposed that a sealing element be interposed between the casing or housing and the commutator. Although such an arrangement provides a seal, it has the disadvantage in that the continuous movement of the seal element relative to the casing causes wear on the sealing element requiring maintenance, repair and replacement.

With a view to overcoming the foregoing problems of distortion and leakage in the prior art rotary valves, the present invention has been made to provide improvements in the inventions of the previously mentioned patent applications.

It is therefore an object of the present invention to provide a rotary valve in which sealing means is provided, thus preventing leakage of fluid between the high and low pressure sides within a valve chamber and thereby improving greatly the efficiency of a fluid motor or pump of the Gerotor type without wear on the sealing element and whereby leakage of the fluid within the valve chamber is positively prevented and the fluid pressure applied to the commutator are balanced to minimize distortion of the commutator.

In accordance with the invention, the rotary valve construction includes a commutator comprising two spaced members movable in unison with one or more sealing elements interposed between the two members comprising the commutator.

DESCRIPTION

A rotary valve provided in accordance with this invention is designed for use with fluid rotary machines of the Gerotor type. Irrespective of whether the rotary machine is used as a fluid motor or pump, the Gerotor unit of the identical construction is used in either cases and the machine is usable either as a motor or pump. In the embodiments described hereunder, the rotary valve of this invention is used with a fluid motor of the Gerotor type.

Figure 4:
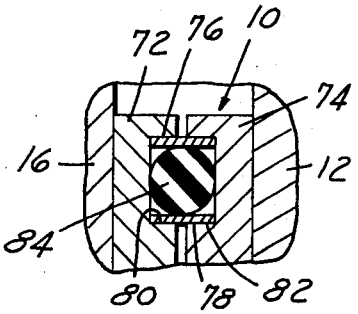
FIG. 4 is a fragmentary sectional view on an enlarged scale of a portion of the motor shown in FIGS. 1 and 2.
Figure 2:
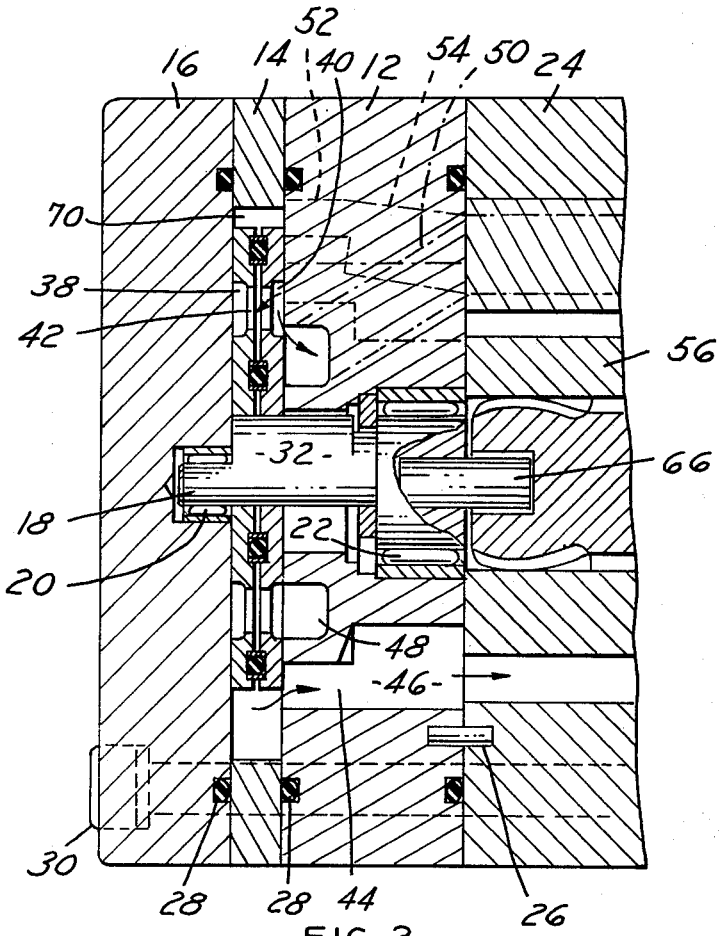
FIG. 2 is a fragmentary sectional view on an enlarged scale of a portion of the motor shown in FIG. 1.
Figure 5:
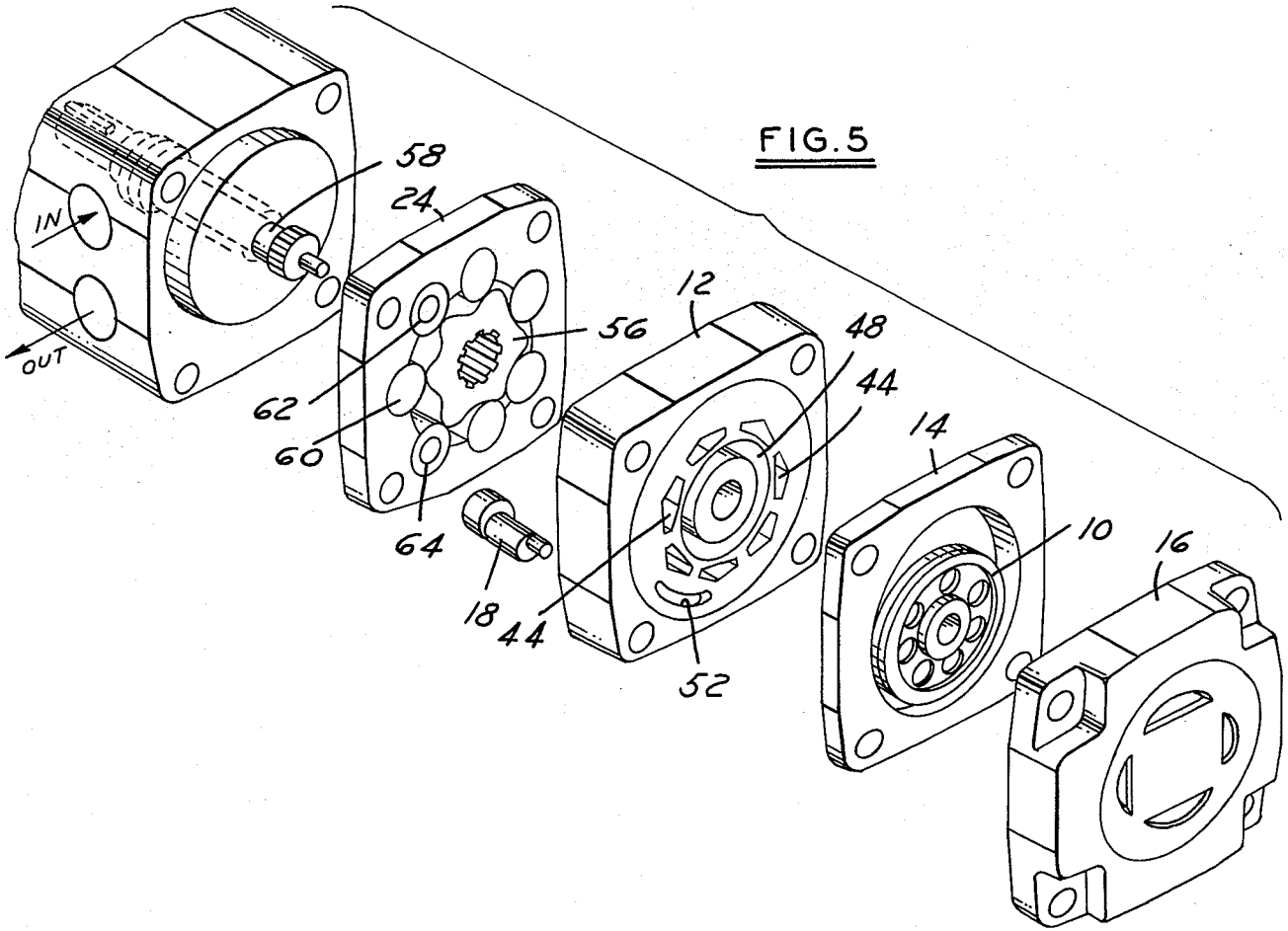
FIG. 5 is a fragmentary exploded perspective view of the motor.
Figure 6:
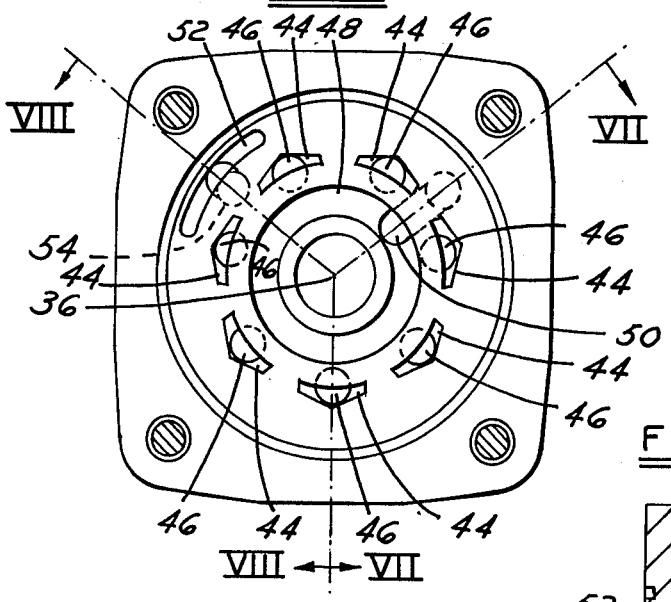
FIG. 6 is an elevational view of a port member utilized in the motor.
Figure 7:
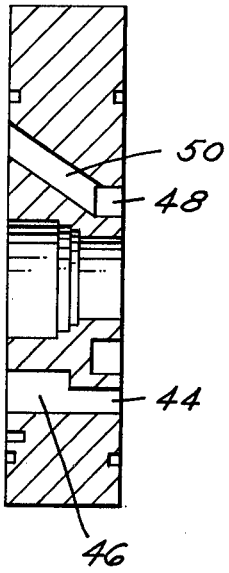
FIG. 7 is a sectional view taken along the line 7—7 in FIG. 6.
Figure 8:
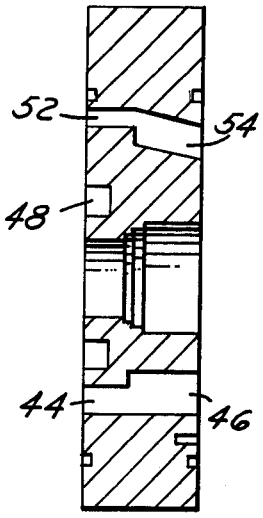
FIG. 8 is a sectional view taken along the line 8—8 in FIG. 6.

As shown in the FIGS. 2, 4 and 5, the rotary valve comprises a commutator 10, a port member 12, a spacer 14, an end cover 16 and an eccentric circular cam 18. The eccentric circular cam 18 is rotatably supported in roller bearings 20 and 22 which are assembled in the end cover 16 and the port member 12, respectively. The spacer 14 is interposed between the end cover 16 and the port member 12 to define a valve chamber, and these component parts and a Gerotor stator 24 are accurately positioned by locating pins 26 and firmly fastened together with bolts 30 with seals 28 interposed therebetween. The commutator 10 is rotatably mounted on the eccentric circular cam 18 within the valve chamber.

A cam portion 32 of the eccentric circular cam 18 has its center offset from an axis of rotation of the eccentric circular cam 18, and the commutator 10 is fitted on the cam portion 32. As a result, when the cam 18 is rotated, the commutator 10 is rotated with the valve chamber eccentrically or in an orbit with respect to the axis of the cam 18. Commutator 10 is provided with annular grooves 38 and 40 which are formed in its sides, and these annular grooves 38 and 40 communicate with each other through a suitable number of holes 42.

Referring to FIGS. 2, 6, 7 and 8, the side of the port member 12 which is opposite to the commutator 10, is formed with seven elongated grooves 44 which are arranged at equal spacing along the same circumference around the axis of the eccentric circular cam 18, and these elongated grooves 44 are connected to the other side of the port member 12 through holes 46. An annular groove 48 is similarly formed concentrically with the shaft center on the inner side of the grooves 44, and the groove 48 is also connected to the other side of the port member 12 through a hole 50. An elongated elliptic groove 52, which is circumferentially curved about the center of the shaft on the outer side of the diamond-shaped grooves 44, is also connected to the other side of the port member 12 through a hole 54.

Figure 1:
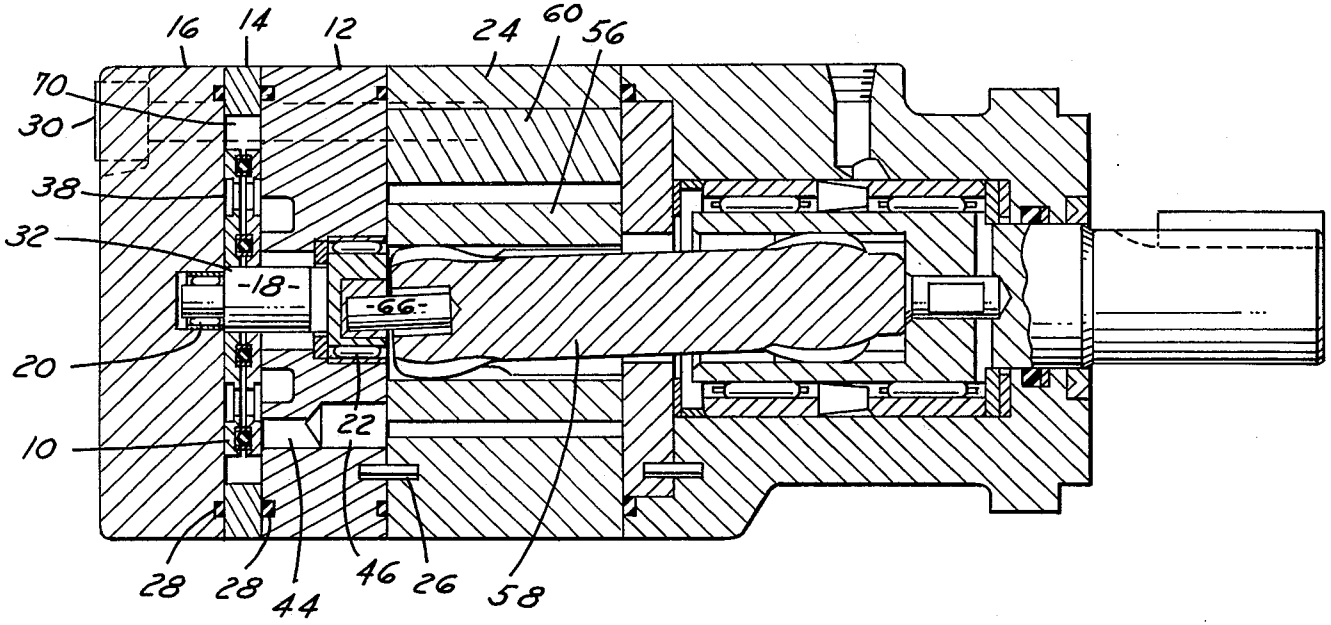
FIG. 1 is a longitudinal sectional view showing the construction of a motor embodying the invention.
Figure 3:
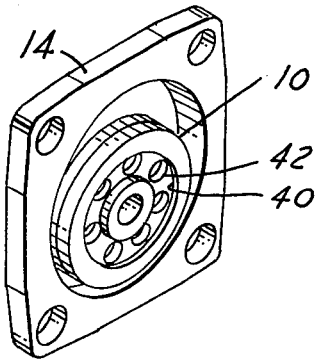
FIG. 3 is a perspective view of the rotary valve.
Figure 9:
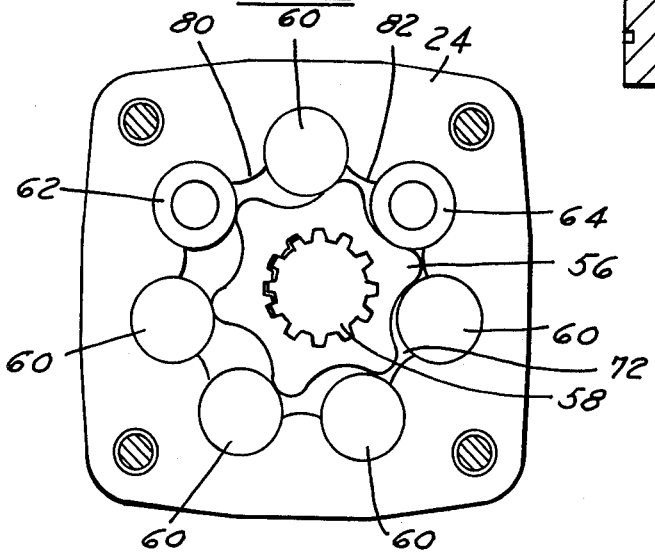
FIG. 9 is an elevational view of a stator and rotor utilized in the motor.

Referring to FIGS. 1, 5 and 9, the Gerotor unit comprises the stator 24, a rotor 56 and a drive shaft 58, and five round bars 60 and hollow bushings 62 and 64 are fitted in the stator 24 thus forming seven internal teeth thereon. The holes of the hollow bushings 62 and 64 constitute oil inlet and outlet passages and their positions respectively communicate with the hole 54 of the port member 12 and the hole 50 of the port member 12. The rotor 56 is formed with one less tooth than the number of teeth of the stator 24, and meshes with the internal teeth of the stator 24. The rotor 56 which is in mesh with the internal teeth of the stator 24 rotates about the center of the stator 24 while rotating on its axis. The orbiting of a center of the rotor 56 follows a circular path. The center of the stator 24 coincides with the axis of rotation of the eccentric circular cam 18. Drive shaft 58 is coupled by spline grooves to the central portion of the rotor 56, and the rotation of the rotor 56 on its axis is transmitted to the drive shaft 58. In this case, the center of the rotor 56 makes one rotation about the center 36 of the stator 24 or one orbiting rotation for every 1/6 rotation of the rotor 56 on its axis, for example. The cavities or chambers which are separated from one another are defined between the stator 24 and the rotor 56 and each of the cavities is varied in volume as the rotor 56 is rotated. As the rotor 56 is rotated, some of the cavities are increased in volume and the other cavities are decreased in volume. As a result, if the hydraulic oil is introduced into some cavities, and the oil in the other cavities is discharged to the outlet, the rotor 56 is rotated clockwise and the rotation on its axis is transmitted to the drive shaft 58, thus causing the Gerotor to operate as a motor. In this case, since there is the previously mentioned relation between the orbiting and the rotation on its axis for making one rotation of the drive shaft 58, the hydraulic oil for 7 cavities $\times$ 6 (rotations) = 42 cavities is introduced. Thus, the hydraulic motor of the Gerotor type is capable of providing 1/6 speed reduction with an output torque which is 6 times that of the prior art hydraulic motors. The previously mentioned rotary valve is designed so that hydraulic oil is alternately supplied to and discharged from the Gerotor cavities so as to continuously rotate the Gerotor rotor 56 smoothly. For this purpose, as shown in FIG. 1, the rotation of the drive shaft 58 is transmitted to the eccentric circular cam 18 by way of a pin 66 and the commutator 10 is rotated to change the connections of the oil passages. On the drive shaft 58 side, the pin 66 is fitted in the central portion of the drive shaft 58, and on the cam 18 side the pin 66 is fitted in an elongated hole of the cam 18. The center of the drive shaft 58 moves to describe a circular path in response to the rotation of the rotor 56, and thus the pin 66 is fitted in the hole of the drive shaft at a position so that the center of the pin 66 is deviated from the center of axis of the cam 18 by an amount corresponding to the radius of the circular path, thus transmitting the orbital rotation of the rotor 56 to the eccentric cam 18.

In accordance with well known understanding of the operation of such type motors, as the hydraulic oil is supplied to some of the cavities, the rotary valve and particularly the commutator function to selectively connect the expanding chambers with the fluid input and the contracting with the fluid output. Such an arrangement is well known as shown, for example, in U.S. Pat. Nos. 3,316,814, 3,452,680 and 3,558,245, which are incorporated herein by reference for the description of the operation.

While the construction and operation of the Gerotor type motor with the rotary valve have been described briefly, such Gerotor type motor or pump is disadvantageous in that the oil leaks from the high pressure portion to the low pressure portion in the rotary valve thus deteriorating the efficiency of the machine. Consider the case of the Gerotor type motor shown in FIG. 1, when the cavity 70 in the valve chamber is on the inlet side of hydraulic oil with a higher pressure and the annular grooves 38 and 40 of the commutator 10 and the annular groove 48 of the port member 12 are on the outlet side of hydraulic oil with a lower pressure. If the commutator valve 10 is made of a single rigid member with operating clearance, the oil will leak from the inlet side to the outlet side through the gap between the commutator 10 and the end cover 16 or through the gap between the commutator 10 and the port member 12.

Similarly, if the annular groove 48 is pressurized, there will be leakage through the same gaps toward cavity 70. In addition, in a design of the kind shown in FIG. 1, there is a vented area around eccentric cam 18 and leakage will occur from annular grooves 38 and 40 to this vented area.

In the past it has been customary to use a method of improving the finishing accuracy of the spacer 14, the commutator 10 and the end cover 16 so as to make the clearance on each side of the commutator 10 as small as possible and thereby to minimize oil leakage. However, when such a method is used, there is a possibility of increasing the clearances due to the clamping pressure of the clamping bolts, due to distortion caused by internal hydraulic pressures or due to thermal dimensional changes or distortion.

In accordance with the invention, the commutator 10 is made of two members 72, 74 having their outer surfaces contacting respectively the end cover 16 and the port member 12. Sealing means are provided between members 72, 74, herein shown as two separate units. Each unit comprises spaced outer and inner rings 76, 78 are interposed in grooves 80, 82 in the members 72, 74, respectively, and a sealing element 84 is provided between the rings and sealingly engages the base of the grooves 80, 82. The rings 76, 78 function to cause the members 72, 74 to move in unison and to also radially confine the sealing element 84.

In this arrangement, when the commutator is moved in an orbital manner, an effective seal is provided without causing wear of the seal thereby insuring long life and minimum maintenance. The contacting surfaces of the commutator 10 with the end cover 16 and port member 12 are suitably treated or made of suitable material to insure long life.

In practice, the resilience of the seal axially will place the contacting faces of the commutator members 72, 74 in initial contact with the end cover 16 and seal member 12. Hydrostatic pressure acting between the members 72, 74 radially inwardly or radially outwardly will hold the faces in contact against the pressure gradients that act across the orbiting faces of the commutator. The resilience of the seal axially will avoid mechanical seizure between the commutator and the end cover and port member such as might occur upon thermal expansion.

The invention claimed is:

1. In a Gerotor type hydraulic motor or pump wherein a rotary valve selectively provides communications to ports, the improvement wherein said rotary valve comprises a commutator adapted to be positioned between spaced surfaces and moved in an orbital path with respect to said surfaces, said commutator comprising spaced members, means extending between said members such that they are moved in unison, said members having contacting faces for engaging the respective surfaces, one member engaging one surface and the other engaging the other surface, and sealing means between said members yieldingly urging said members against their respective contacting surfaces at all times.

2. The rotary valve set forth in claim 1 wherein said means extending between said members comprises radially spaced rings extending between said members.

3. The rotary valve set forth in claim 2 wherein each of said members has a groove into which said rings extend, said sealing means being interposed between said rings and sealingly engaging the base of said grooves.

4. The rotary valve set forth in claim 1, 2 or 3 wherein said sealing means comprises a resilient ring.

5. The rotary valve set forth in claim 1, 2, or 3 wherein said ring comprises an O-ring.

* * * * *